US008973180B2

(12) United States Patent
Zeng et al.

(10) Patent No.: US 8,973,180 B2
(45) Date of Patent: Mar. 10, 2015

(54) CRIB AND REVERSIBLE CHANGING TABLE THEREOF

(75) Inventors: Hai-Bo Zeng, Guangdong (CN); Ganqing Fang, Guangdong (CN); Guang-Hui Zhao, Guangdong (CN)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 298 days.

(21) Appl. No.: 13/572,702

(22) Filed: Aug. 13, 2012

(65) Prior Publication Data

US 2013/0047335 A1 Feb. 28, 2013

(30) Foreign Application Priority Data

Aug. 30, 2011 (CN) ..... 2011 2 0320555 U
Dec. 16, 2011 (CN) ..... 2011 1 0429206

(51) Int. Cl.
*A47D 13/06* (2006.01)
*A47D 5/00* (2006.01)
*A47D 7/04* (2006.01)

(52) U.S. Cl.
CPC . *A47D 5/006* (2013.01); *A47D 7/04* (2013.01)
USPC ..... 5/93.1; 5/93.2; 5/97; 5/99.1

(58) Field of Classification Search
CPC ..... A47D 5/00; A47D 5/006
USPC ..... 5/93.1, 93.2, 97, 99.1
See application file for complete search history.

(56) References Cited

U.S. PATENT DOCUMENTS

| | | | | |
|---|---|---|---|---|
| 5,918,329 | A * | 7/1999 | Huang | 5/93.1 |
| 6,173,462 | B1 * | 1/2001 | Huang et al. | 5/655 |
| 6,543,070 | B2 * | 4/2003 | Longenecker et al. | 5/93.1 |
| 6,948,197 | B1 | 9/2005 | Chen | |
| 7,950,081 | B2 * | 5/2011 | Chen et al. | 5/93.2 |
| 2008/0034506 | A1 | 2/2008 | Chen | |
| 2010/0162484 | A1 * | 7/2010 | Thomas et al. | 5/93.2 |
| 2012/0204347 | A1 | 8/2012 | Li | |

FOREIGN PATENT DOCUMENTS

| | | | |
|---|---|---|---|
| DE | 199 41 332 | A1 | 3/2000 |
| DE | 10 2011 109 874 | A1 | 3/2012 |
| EP | 2671472 | A1 * | 12/2013 |
| GB | 2488225 | B * | 3/2013 |
| GB | 2494266 | * | 3/2013 |

* cited by examiner

*Primary Examiner* — Michael Trettel
(74) *Attorney, Agent, or Firm* — Winston Hsu; Scott Margo

(57) ABSTRACT

A reversible changing table installed on a crib frame of a crib includes a bracket and a pivoting mechanism. The pivoting mechanism is disposed on at least one corner of the bracket and has a locking mechanism. The bracket is installed on the crib frame through the pivoting mechanism such that the bracket is capable of being rotated with respect to the crib frame, and the locking mechanism is used for preventing the bracket from being rotated with respect to the crib frame.

41 Claims, 20 Drawing Sheets

CRIB AND REVERSIBLE CHANGING TABLE THEREOF

BACKGROUND OF THE INVENTION

1. Field of the Invention

The invention relates to a crib and, more particularly, to a crib equipped with a reversible changing table. Specifically, the changing table can be attached to or detached from a crib frame of the crib easily.

2. Description of the Prior Art

The structure of a current crib mainly comprises a crib frame and a cover, wherein the crib frame is used for supporting the crib and the cover is disposed on the crib frame for protection purpose. Accordingly, the crib can provide a comfortable sleeping or activity space for a baby. In general, the crib frame essentially consists of metal tubes and plastic members for connecting the metal tubes and the cover is usually made of fabric. Furthermore, in order to satisfy various requirements of consumers on the crib, there are usually a lot of additional accessories installed on the crib, such as a sleeping apparatus, a changing table, and so on.

However, the sleeping apparatus, which provides space for the baby to rest, and the changing table, which is used for diapering the baby, are arranged side by side on the crib frame of the current crib. The aforesaid arrangement occupies more space of the crib such that the space of the crib cannot be used efficiently. Moreover, the sleeping apparatus and the changing table are installed on the crib through other components such that the structure of the crib becomes more complicated due to the components.

Still further, a bracket of the changing table of the current crib is usually made of one single metal tube, i.e. the volume of the bracket is fixed. However, the volume of the bracket is usually larger than others such that the bracket of the changing table has to be packaged with much more package materials. Consequently, the volume of the bracket after package will get large and it is inconvenient for packaging and transporting the changing table.

SUMMARY OF THE INVENTION

An objective of the invention is to provide a reversible changing table installed on a crib, wherein the reversible changing table occupies less space and has simple structure.

Another objective of the invention is to provide a crib equipped with a reversible changing table, which occupies less space and has simple structure.

Another objective of the invention is to provide a reversible changing table, which can reduce package materials of a bracket of the changing table so as to package and transport the changing table more easily and conveniently.

According to an embodiment of the invention, a reversible changing table installed on a crib frame of a crib comprises a bracket and a pivoting mechanism. The pivoting mechanism is disposed on at least one corner of the bracket and has a locking mechanism. The bracket is installed on the crib frame through the pivoting mechanism such that the bracket is capable of being rotated with respect to the crib frame, and the locking mechanism is used for preventing the bracket from being rotated with respect to the crib frame.

Preferably, the bracket comprises an outer tube and an inner tube, wherein the outer tube is slidably connected to the inner tube so as to form the bracket.

According to another embodiment of the invention, a crib comprises a crib frame and a reversible changing table. The reversible changing table is installed on the crib frame and comprises a bracket and a pivoting mechanism. The pivoting mechanism is disposed on at least one corner of the bracket and has a locking mechanism. The bracket is installed on the crib frame through the pivoting mechanism such that the bracket is capable of being rotated with respect to the crib frame, and the locking mechanism is used for preventing the bracket from being rotated with respect to the crib frame.

Preferably, the bracket comprises an outer tube and an inner tube, wherein the outer tube is slidably connected to the inner tube so as to form the bracket.

As mentioned in the above, since the reversible changing table of the invention comprises the pivoting mechanism and the bracket, which is installed on the crib frame through the pivoting mechanism, the bracket is capable of being rotated with respect to the crib frame. Furthermore, the locking mechanism of the pivoting mechanism can be used for preventing the bracket from being rotated with respect to the crib frame. Therefore, a first surface and a second surface with different functions can be arranged on opposite sides of the bracket and the bracket can be rotated with respect to the crib frame so as to use the first surface or the second surface selectively. Accordingly, the reversible changing table of the invention occupies less space of the crib such that the space of the crib can be used efficiently. Still further, the reversible changing table of the invention has simple structure and can be used conveniently.

Moreover, if the bracket comprises an outer tube and an inner tube and the outer tube is slidably connected to the inner tube so as to form the bracket, the inner tube can slide into the outer tube when packaging the bracket so as to reduce the volume of the bracket and reduce package materials of the bracket. Accordingly, the changing table can be packaged and transported more easily and conveniently.

These and other objectives of the present invention will no doubt become obvious to those of ordinary skill in the art after reading the following detailed description of the preferred embodiment that is illustrated in the various figures and drawings.

DETAILED DESCRIPTION

Please refer to the embodiments of the invention illustrated in the figures, wherein the same elements in the figures are represented by the same numerals.

Figure 1:
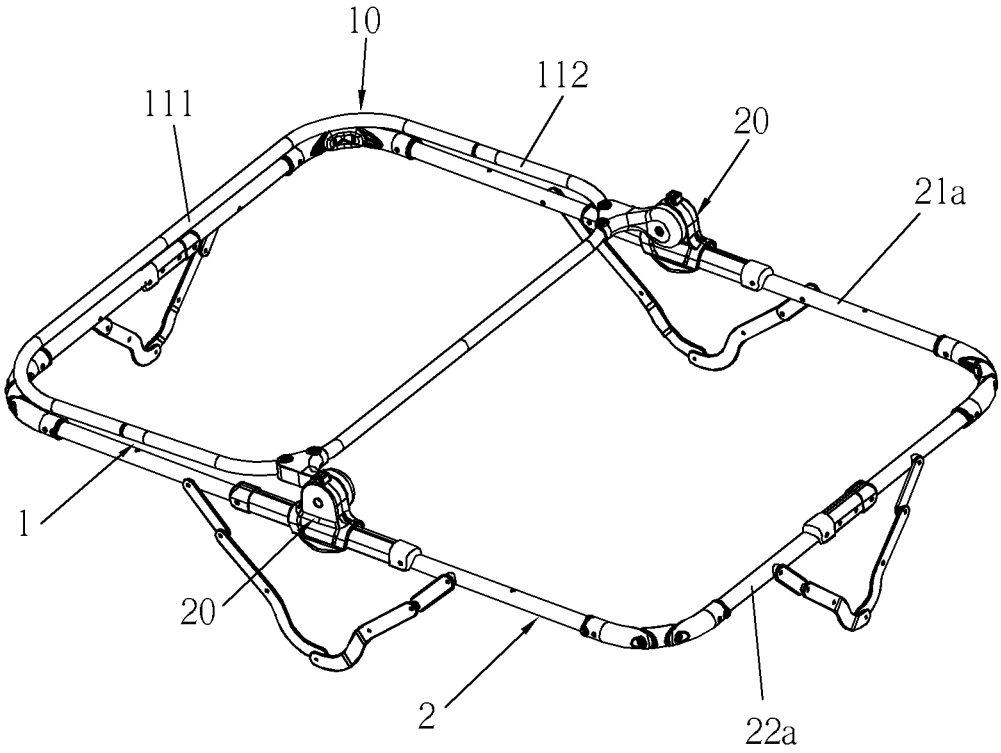
FIG. 1 is a schematic diagram illustrating a crib according to an embodiment of the invention.

As shown in FIG. 1, the crib of the invention comprises a reversible changing table 1 and a crib frame 2. The crib frame 2 is rectangular and essentially consists of two long connecting rods 21*a* and two short connecting rods 22*a*. The reversible changing table 1 is installed on middle portions of the long connecting rods 21*a* and can be rotated with respect to the crib frame 2. The other structures of the crib frame 2 are well known by one skilled in the art and will not be depicted herein.

Specifically, the reversible changing table 1 comprises a bracket 10 and a pivoting mechanism which comprising two first pivoting assemblies 20. The bracket 10 essentially consists of two long support tubes 111 and two short support tubes 112 such that the bracket 10 is also rectangular. The long support tubes 111 are corresponding to the short connecting rods 22*a* of the crib frame 2. The first pivoting assemblies 20 are fixed on opposite corners where both ends of the long support tube 111 connect the two short support tubes 112, respectively. Furthermore, the first pivoting assemblies 20 are fixed on middle portions of the long connecting rods 21*a*. Accordingly, the bracket 10 can be rotated from one end to the other end of the crib frame 2 so as to use two different surfaces of the bracket 10 selectively. In practical applications, different covers are installed on opposite surfaces of the bracket 10 so as to form a first surface and a second surface with different functions. For example, a fabric, which is waterproof and easily cleaned, may be adapted to the first surface so as to form a changing table for diapering a baby, and another fabric, which is tender and soft, may be adapted to the second surface so as to form a sleeping apparatus for a baby to rest or nap. Accordingly, the bracket 10 can be rotated to use the changing table or the sleeping apparatus selectively and the operation is very easy for a user. It should be noted that the opposite surfaces of the bracket 10 are not limited to form the aforesaid changing table and sleeping apparatus and can be equipped with other devices based on practical applications known by one skilled in the art.

In the following, the reversible changing table 1 installed on the crib of the invention will be depicted by different embodiments along with related drawings.

Figure 2:
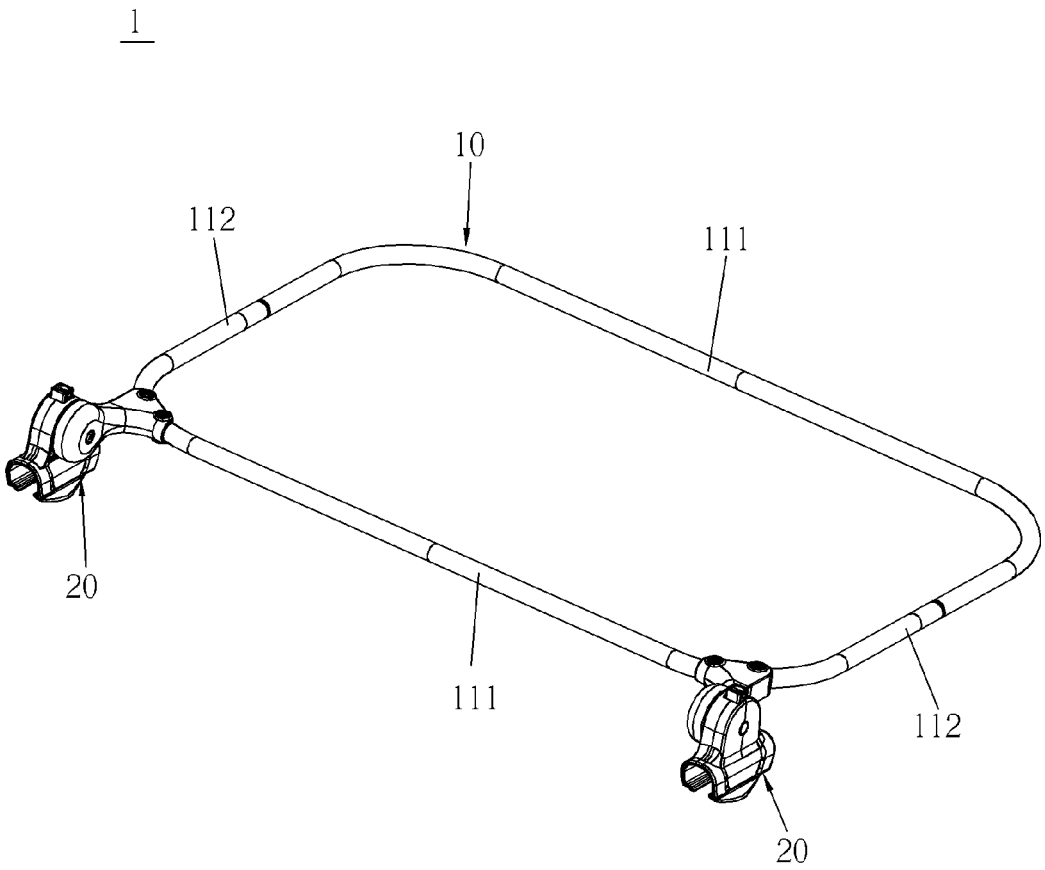
FIG. 2 is a schematic diagram illustrating the reversible changing table shown in FIG. 1 according to a first embodiment.
Figure 3:
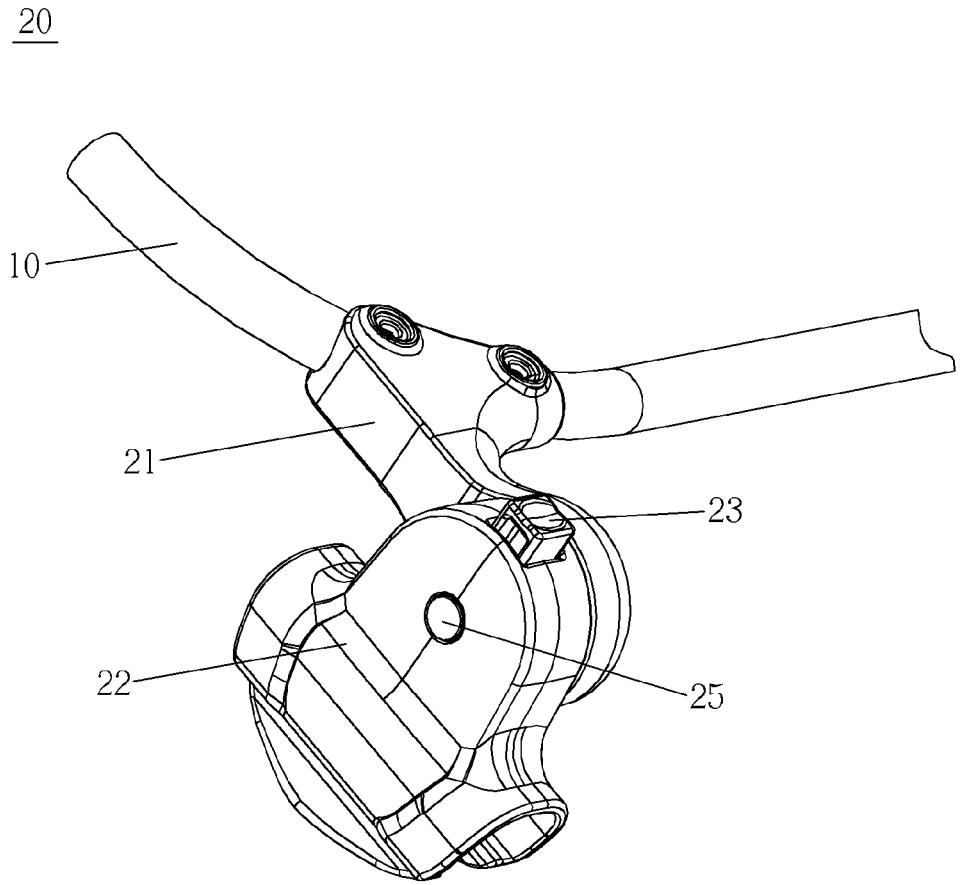
FIG. 3 is a schematic diagram illustrating the first pivoting assembly shown in FIG. 2.
Figure 4:
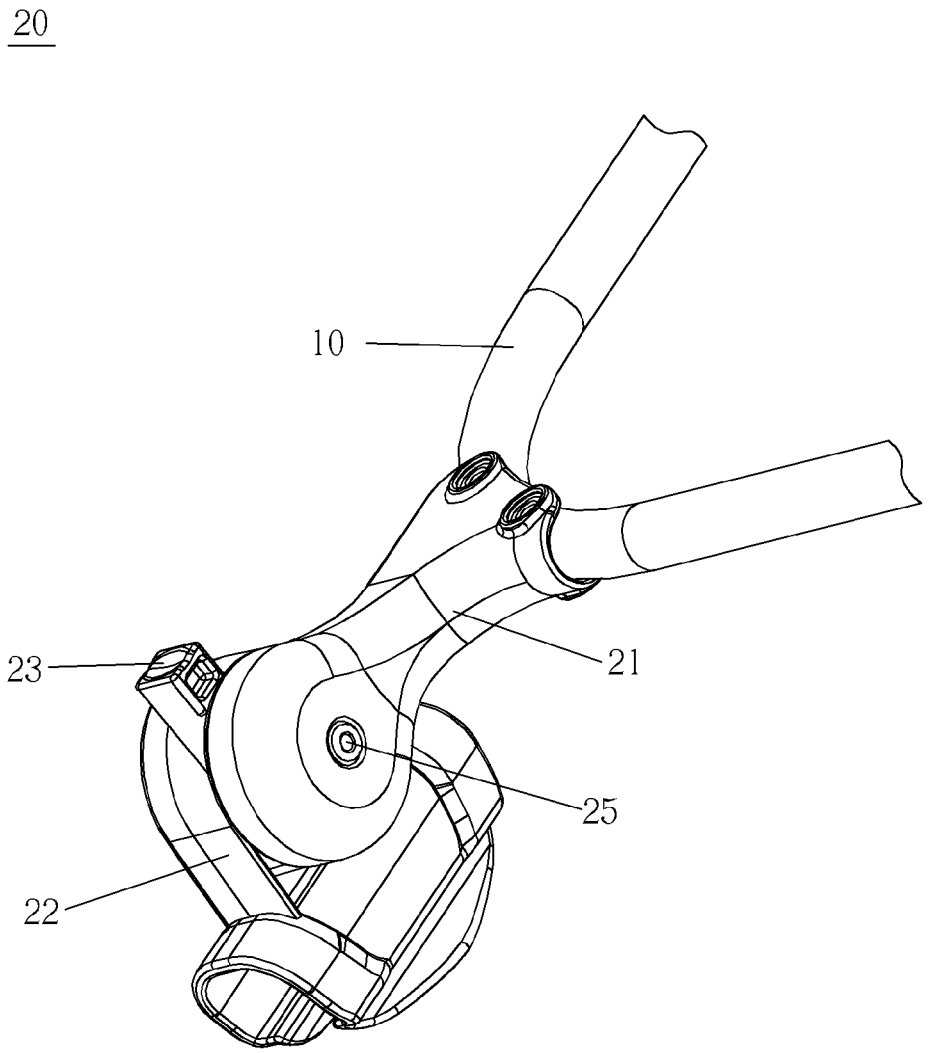
FIG. 4 is a schematic diagram illustrating the first pivoting assembly shown in FIG. 2 from another view angle.

As shown in FIG. 2, in a first embodiment of the reversible changing table 1 of the invention, there are two identical first pivoting assemblies 20 installed on opposite ends of the long support tube 111 and the reversible changing table 1 is installed on middle portions of the long connecting rods 21*a* of the crib frame 2 through the two first pivoting assemblies 20.

Also referring to FIGS. 3 to 6, the first pivoting assembly 20 comprises a first fixing socket 21, a first engaging socket 22, a first pivoting member 25 and a locking mechanism 26, wherein the locking mechanism 26 comprises a button 23 and a resilient member 24. In this embodiment, the resilient member 24 may be a spring and the first pivoting member 25 may be a rivet. The first fixing socket 21 is pivotally connected to the first engaging socket 22 by the first pivoting member 25. The first fixing socket 21 is fixed on the bracket 10 and the first engaging socket 22 is fixed on the crib frame 2. The button 23 is slidably disposed on the first engaging socket 22 and is detachably engaged with the first fixing socket 21. The resilient member 24 is disposed between a bottom of the button 23 and the first engaging socket 22. When the button 23 is engaged with the first fixing socket 21, the first pivoting assembly 20 is locked. When the button 23 is disengaged from the first fixing socket 21, the first pivoting assembly 20 is unlocked and the first fixing socket 21 can rotate with respect to the first engaging socket 22 such that the bracket 10 can be rotated with respect to the crib frame 2.

Figure 5:
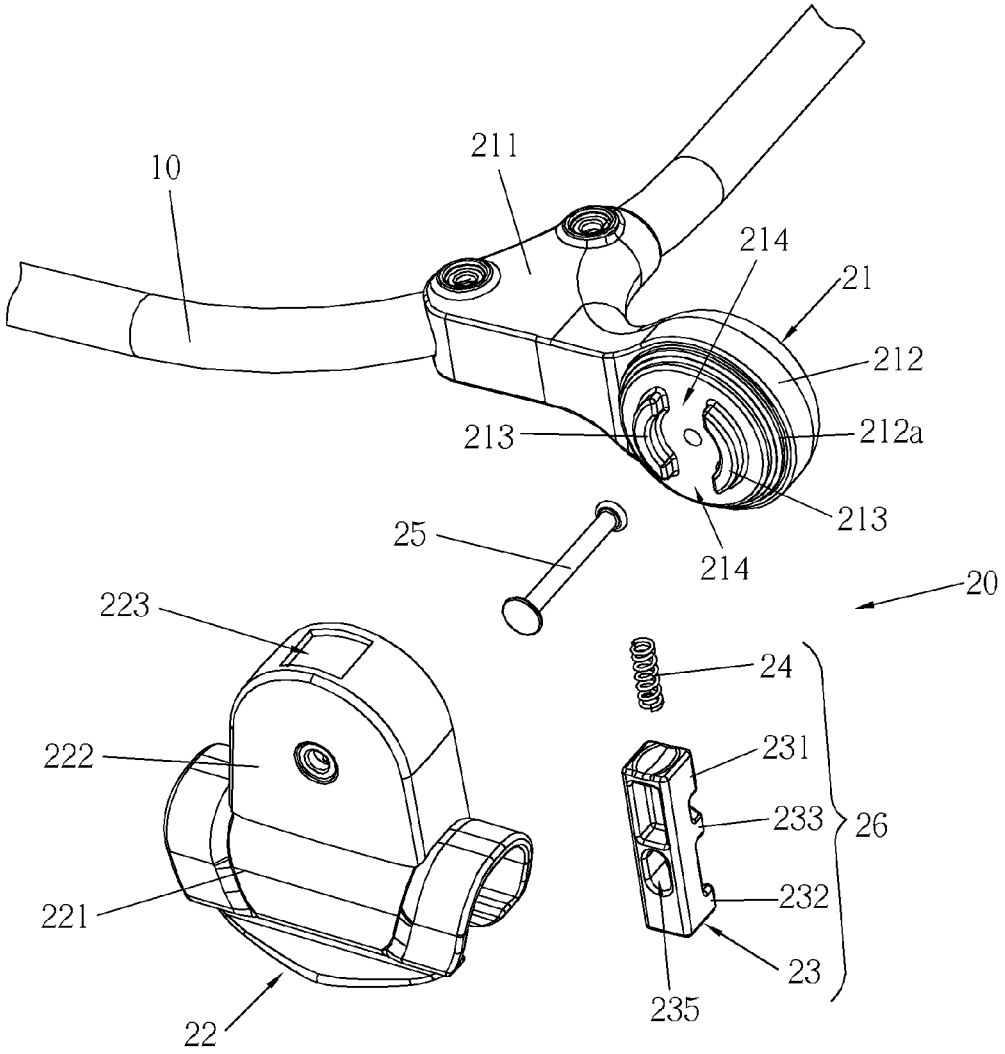
FIG. 5 is an exploded view illustrating the first pivoting assembly shown in FIG. 2.
Figure 6:
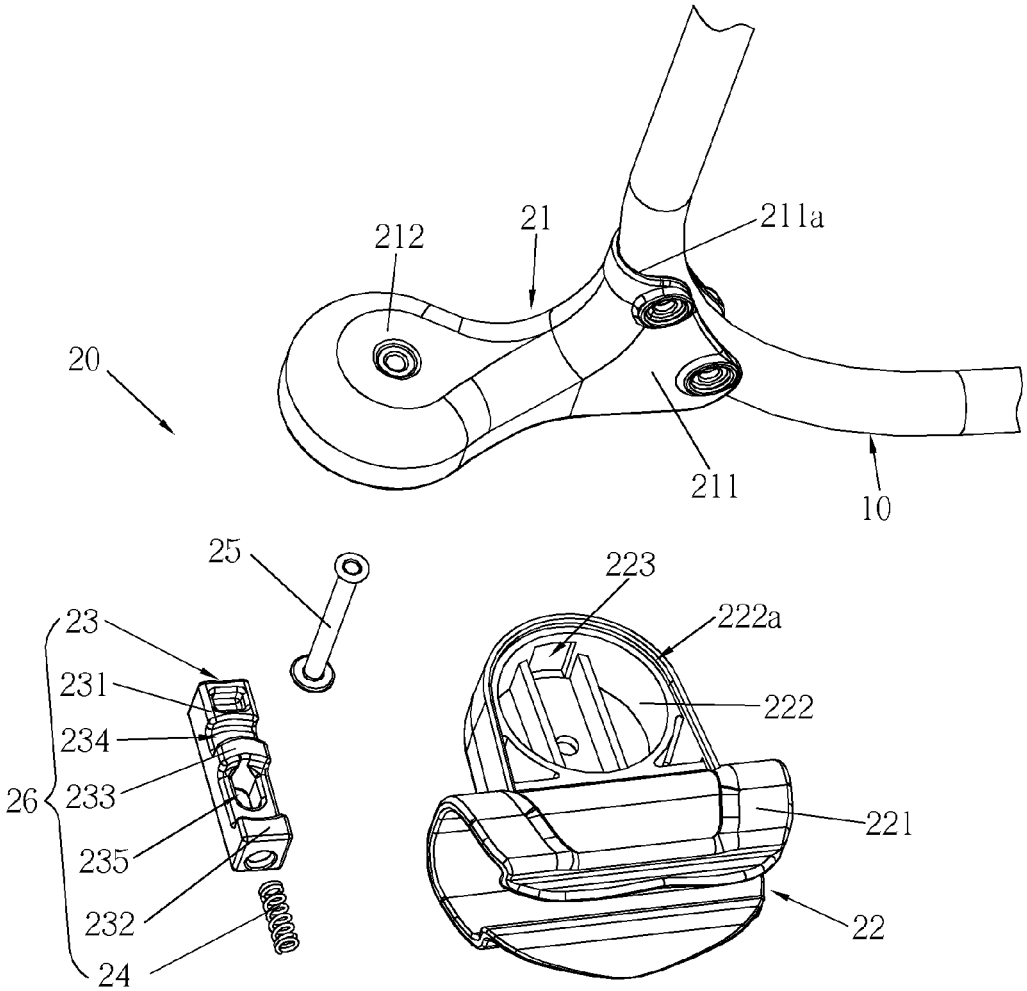
FIG. 6 is an exploded view illustrating the first pivoting assembly shown in FIG. 2 from another view angle.
Figure 7:
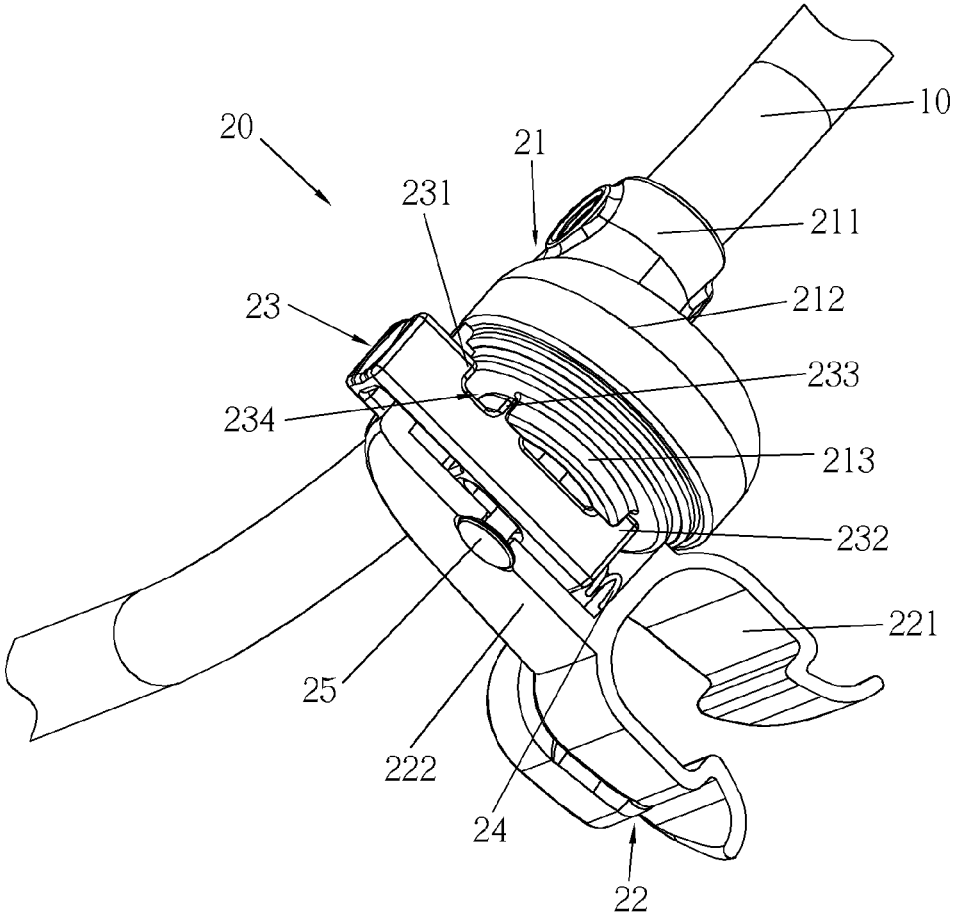
FIG. 7 is a cross-sectional view illustrating the first pivoting assembly shown in FIG. 2.
Figure 8:
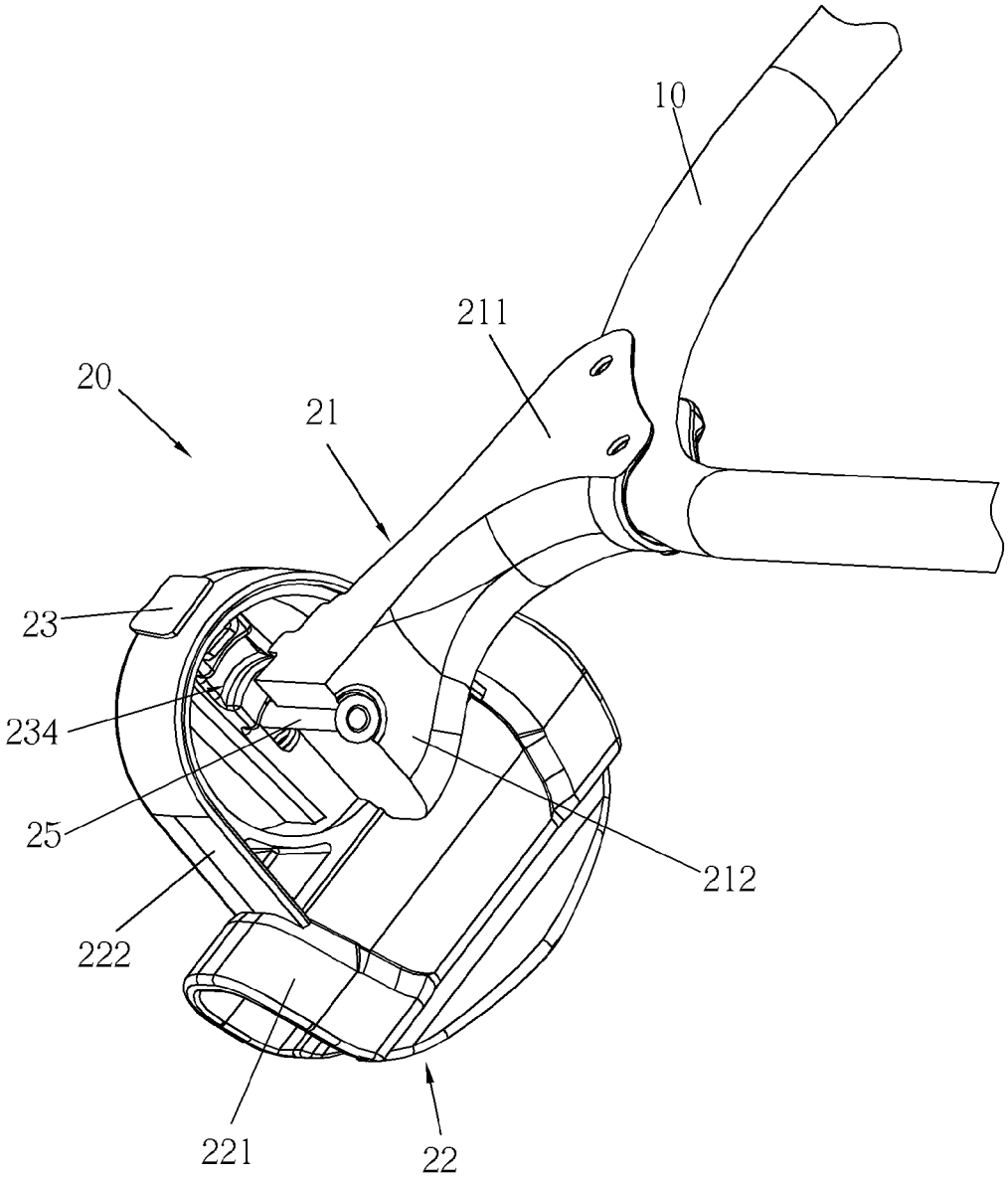
FIG. 8 is another cross-sectional view illustrating the first pivoting assembly shown in FIG. 2.

Referring to FIGS. 5 and 6, one end of the first fixing socket 21 has a first fixing portion 211, a bottom of the first fixing portion 211 is caved in to form a curved structure 211*a*, and the curved structure 211*a* is engaged with the bracket 10. Another end of the first fixing socket 21 has a first pivoting portion 212 with circular shape, a step-shaped structure 212*a* is formed on an edge of an inner surface of the first pivoting portion 212, and the first pivoting portion has two protruding ribs 213 arranged on the inner surface symmetrically. The protruding ribs 213 are arc-shaped and two gaps 214 are formed between the two protruding ribs 213. The center of the first pivoting portion 212 is pivotally connected to the first engaging socket 22 by the first pivoting member 25 and the button 23 is detachably engaged with the protruding ribs 213.

As shown in FIG. 6, lower ends of the first engaging socket 22 curve inwardly so as to form a second fixing portion 221. The second fixing portion 221 is engaged with the long connecting rod 21*a* of the crib frame 2. A second pivoting portion 222 with circular shape protrudes from the second fixing portion 221 and is corresponding to the first pivoting portion 212. An installation groove 223 is formed on and through a top end of the second pivoting portion 222. An engaging groove 222*a*, which is corresponding to the step-shaped structure 212*a* of the first pivoting portion 212, is formed on an edge of an inner surface of the second pivoting portion 222. To assemble the first pivoting assembly 20, the button 23 is slidably accommodated in the installation groove 223 and protrudes from the installation groove 223, the engaging groove 222*a* cooperates with the step-shaped structure 212*a* of the first pivoting portion 212, the first pivoting member 25 passes through the second pivoting portion 222, the button 23 and the first pivoting portion 212 sequentially so as to connect them together, and the button 23 is disposed in the gaps 214 between the two protruding ribs 213 of the first pivoting portion 212 such that the button 23 is slidably engaged with the protruding ribs 213 of the first pivoting portion 212.

Referring to FIGS. 5 to 8, an upper end of the button 23 has a first protruding block 231, a lower end of the button 23 has a second protruding block 232, a middle portion of the button 23 has an engaging block 233, a recess 234 is formed between the first protruding block 231 and the engaging block 233, and a slot 235 is formed between the engaging block 233 and the second protruding block 232. The button 23 is accommodated in the installation groove 223 of the second pivoting portion 222 and an upper end of the button 23 protrudes from the installation groove 223. The resilient member 24 is disposed between the bottom of the button 23 and the second pivoting portion 222. The first pivoting member 25 passes through the second pivoting portion 222, the slot 235 of the button 23 and the first pivoting portion 212 sequentially so as to connect them together. After assembly, the button 23 is located in the gaps 214 between the two protruding ribs 213 and the engaging block 233 and the second protruding block 232 both are engaged between the two protruding ribs 213. Accordingly, the first pivoting assembly 20 is locked and the first fixing socket 21 cannot rotate with respect to the first engaging socket 22. When the button 23 is pressed down, the button 23 slides downwardly so that the two protruding ribs 213 are aligned with the recess 234 of the button 23 and the second protruding block 232 is disengaged from the two protruding ribs 213. At this time, the first pivoting assembly 20 is unlocked and the first fixing socket 21 can rotate with respect to the first engaging socket 22 in 180 degrees so as to rotate the bracket 10 with respect to the crib frame 2. After releasing the button 23, the button 23 will return to the non-press position by an elastic force generated by the resilient member 24 so as to lock the first pivoting assembly 20 again.

Figure 9:
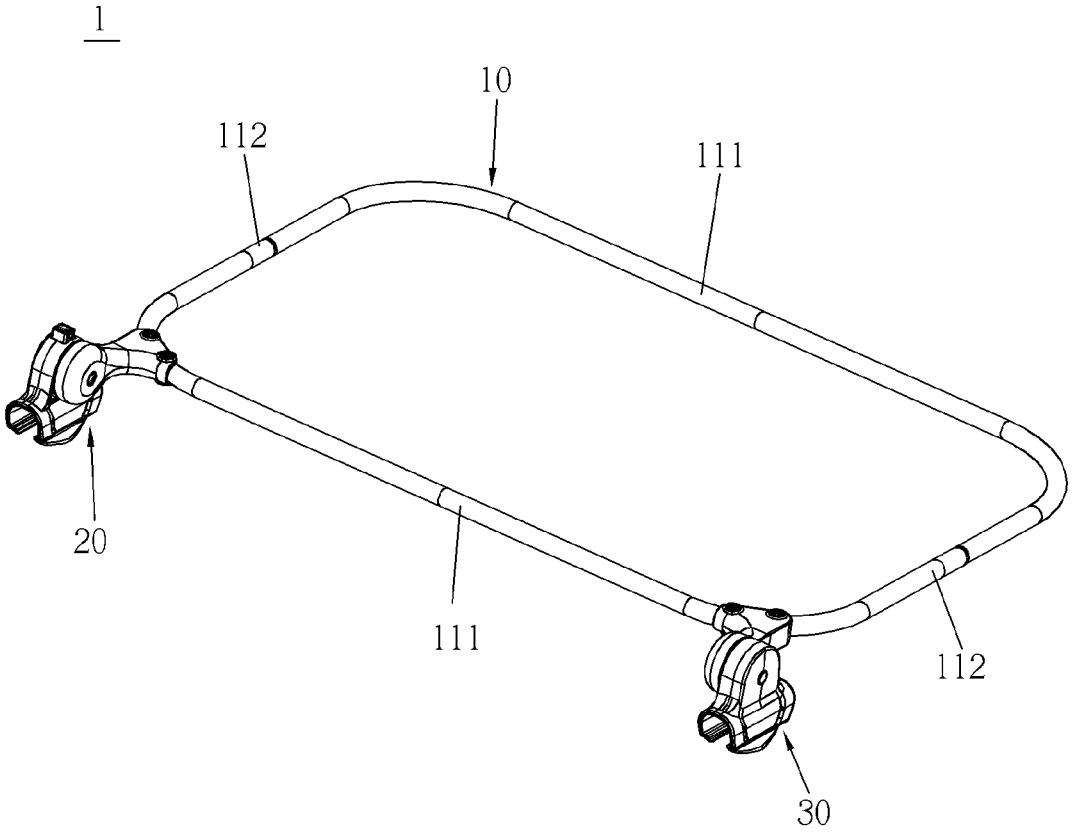
FIG. 9 is a schematic diagram illustrating the reversible changing table shown in FIG. 1 according to a second embodiment.

As shown in FIG. 9, in a second embodiment of the reversible changing table 1 of the invention, the pivoting mechanism is different from that of the aforesaid first embodiment. In this embodiment, the bracket 10 is installed on the crib frame 2 through a pivoting mechanism comprising a first pivoting assembly 20 and a second pivoting assembly 30. The first pivoting assembly 20 and the second pivoting assembly 30 are fixed on opposite ends of the long connecting rod 111 of the bracket 10, respectively, and fixed on the crib frame 2. In this embodiment, the structure of the bracket 10, the structure of the first pivoting assembly 20 and the connection thereof are substantially the same as those of the aforesaid first embodiment and will not be depicted herein again. The structure of the second pivoting assembly 30 will be depicted in the following.

Figure 10:
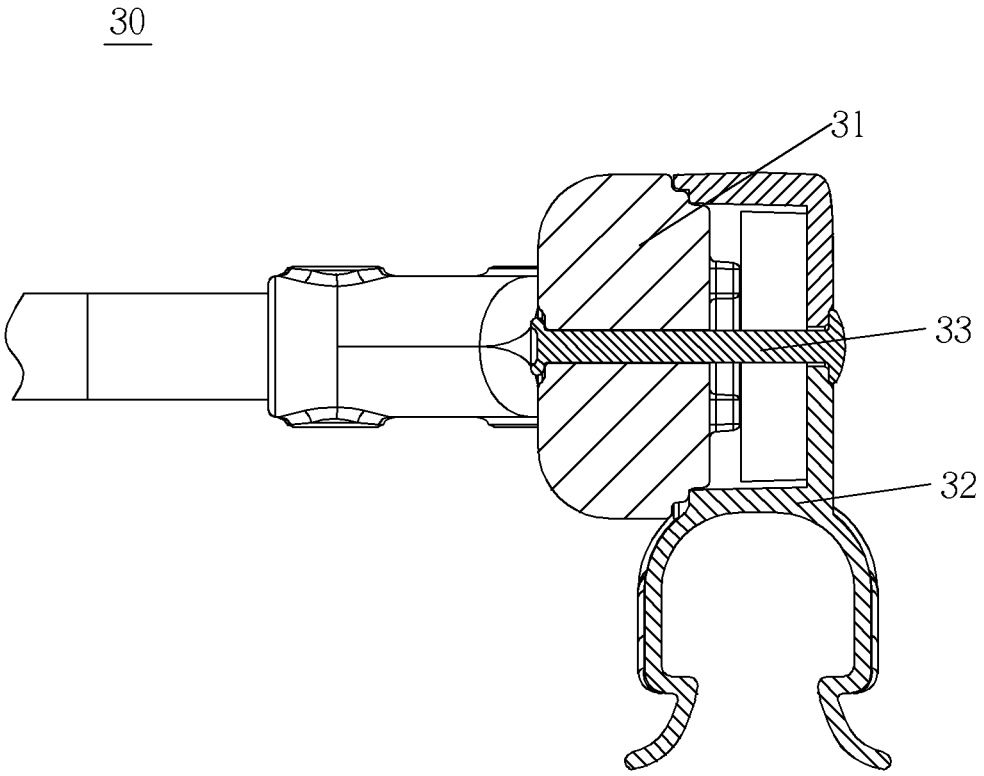
FIG. 10 is a cross-sectional view illustrating the second pivoting assembly shown in FIG. 9.

As shown in FIG. 10, the second pivoting assembly 30 does not comprise the locking mechanism 26 as that of the aforesaid first pivoting assembly 20 and comprises a second fixing socket 31, a second engaging socket 32 and a second pivoting member 33. Preferably, the second pivoting member 33 may be a rivet. However, the second pivoting member 33 may be other connecting members based on practical applications. The second fixing socket 31 is fixed on the bracket 10, the second engaging socket 32 is fixed on the crib frame 2, and the second fixing socket 31 is pivotally connected to the second engaging socket 32 by the second pivoting member 33. The structures of the second fixing socket 31 and the second engaging socket 32 are substantially the same as the structures of the first fixing socket 21 and the first engaging socket 22 of the aforesaid first pivoting assembly 20 and will not be depicted herein again. Accordingly, the bracket 10 can be rotated in 180 degrees as long as the first pivoting assembly 20 is unlocked.

The operation and principle of the reversible changing table 1 of the invention will be depicted with FIGS. 1, 11 and 12 in the following.

The reversible changing table 1 is installed on a middle portion of the crib frame 2 through the first and second pivoting assemblies 20 and 30. The reversible changing table 1 is disposed on one end of the crib frame 2 so as to use one surface thereof selectively. When using the reversible changing table 1, the first pivoting assembly 20 is locked, i.e. the button 23 protrudes from the second pivoting portion 222 of the first engaging socket 22 due to the resilient member 24, and the engaging block 233 and the second protruding block 232 of the button 23 are engaged between the protruding ribs 213 of the first pivoting portion 212. Accordingly, the first fixing socket 21 cannot rotate with respect to the first engaging socket 22 and the bracket 10 cannot be rotated with respect to the crib frame 2.

Figure 11:
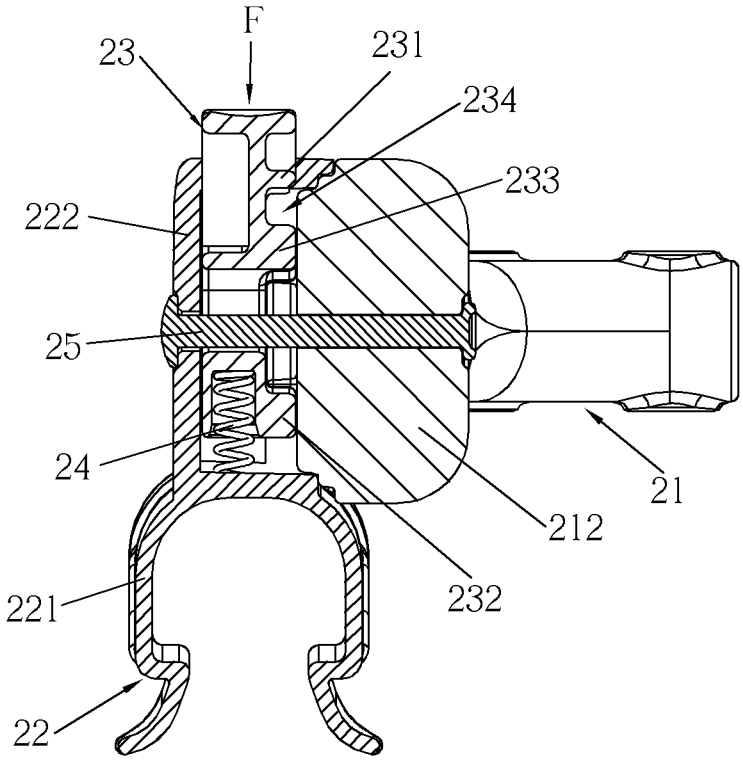
FIG. 11 is a cross-sectional view illustrating the first pivoting assembly of the invention being locked.
Figure 12:
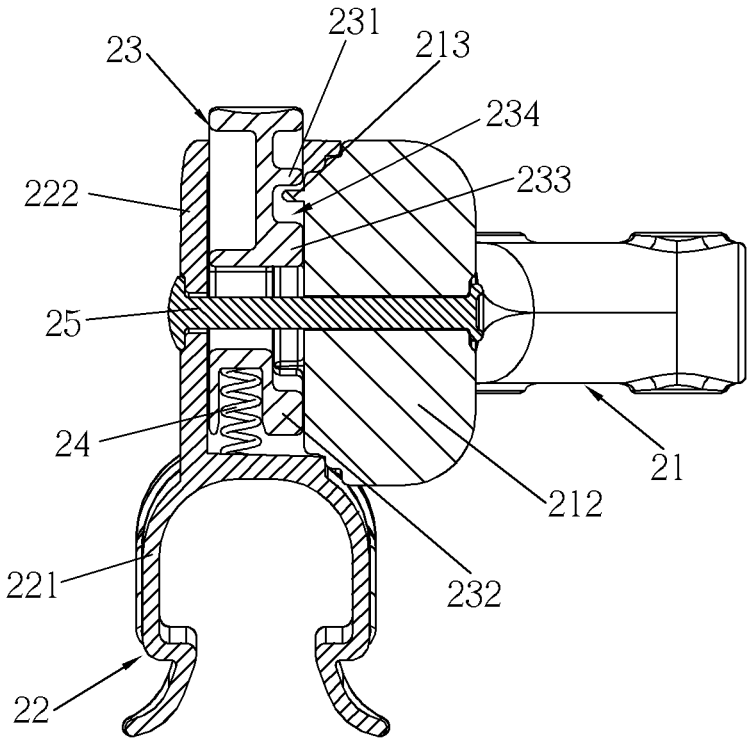
FIG. 12 is a cross-sectional view illustrating the first pivoting assembly of the invention being unlocked.

When a user wants to use the other surface of the reversible changing table 1, he or she can press down the button 23 by a force F in a direction indicated by an arrow shown in FIG. 11. When the button 23 slides downwardly, the recess 234 is aligned with the protruding ribs 213 of the first pivoting portion 212 and the second protruding block 232 is disengaged from the protruding ribs 213. At this time, the bracket 10 can be pushed to rotate the first fixing socket 21 with respect to the first engaging socket 22. The protruding ribs 213 are accommodated in the recess 234 during rotation of the bracket 10. After the bracket 10 is rotated 180 degrees, the button 23 is released and returns to the non-press position by an elastic force generated by the resilient member 24 such that the engaging block 233 and the second protruding block 232 are engaged between the two protruding ribs 213 again. Consequently, the opposite surfaces of the bracket 10 can be changed with each other such that the user can use any one of the opposite surfaces with different functions of the bracket 10 selectively. The structures of the bracket 10 and the first and second pivoting assemblies 20, 30 are simple and the bracket 10 occupies less space of the crib frame 2 such that the space of the crib can be used efficiently.

Since the reversible changing table 1 of the invention comprises the first and second pivoting assemblies 20, 30 and the bracket 10, which is installed on the crib frame 2 through the first and second pivoting assemblies 20, 30, the bracket 10 is capable of being rotated with respect to the crib frame 2. A first surface and a second surface with different functions can be arranged on opposite sides of the bracket 10 and the bracket 10 can be rotated with respect to the crib frame 2 so as to use the first surface or the second surface selectively. Accordingly, the reversible changing table 1 of the invention occupies less space of the crib such that the space of the crib can be used efficiently. Still further, the reversible changing table 1 of the invention has simple structure and can be used conveniently.

Figure 13:
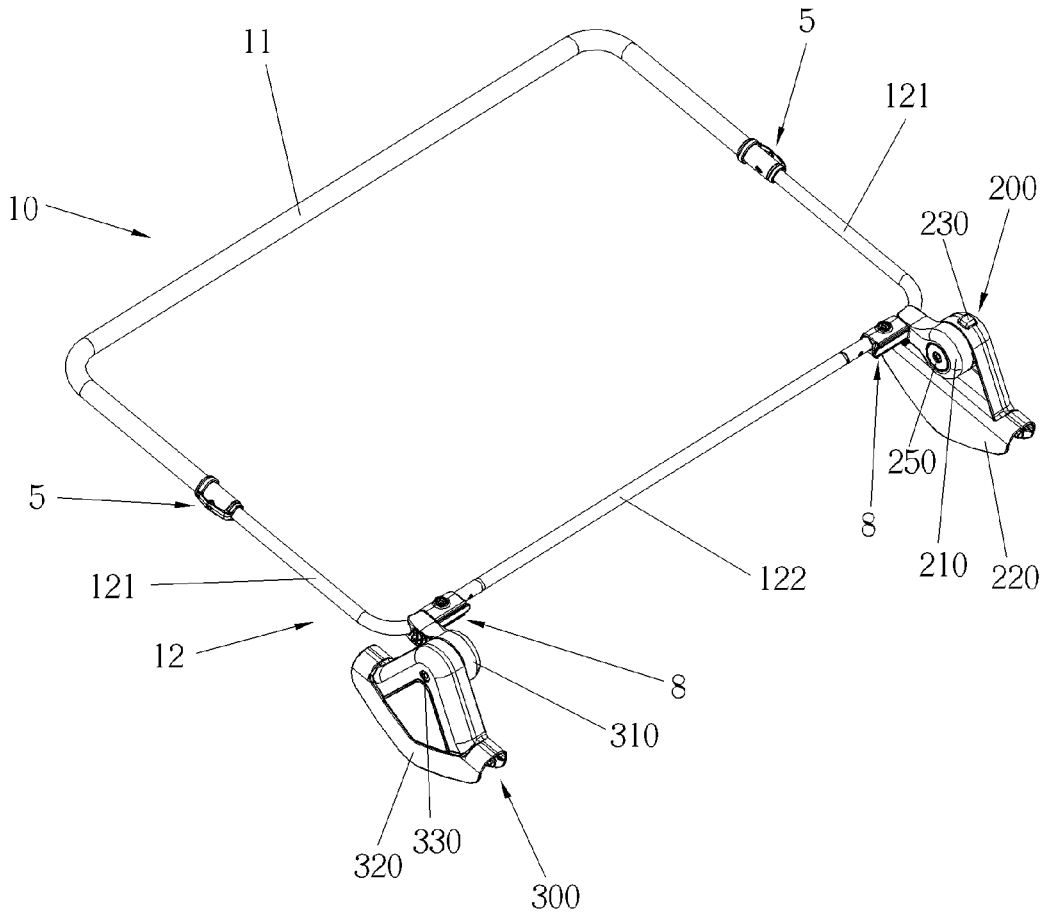
FIG. 13 is a schematic diagram illustrating the reversible changing table shown in FIG. 1 according to a third embodiment.
Figure 14:
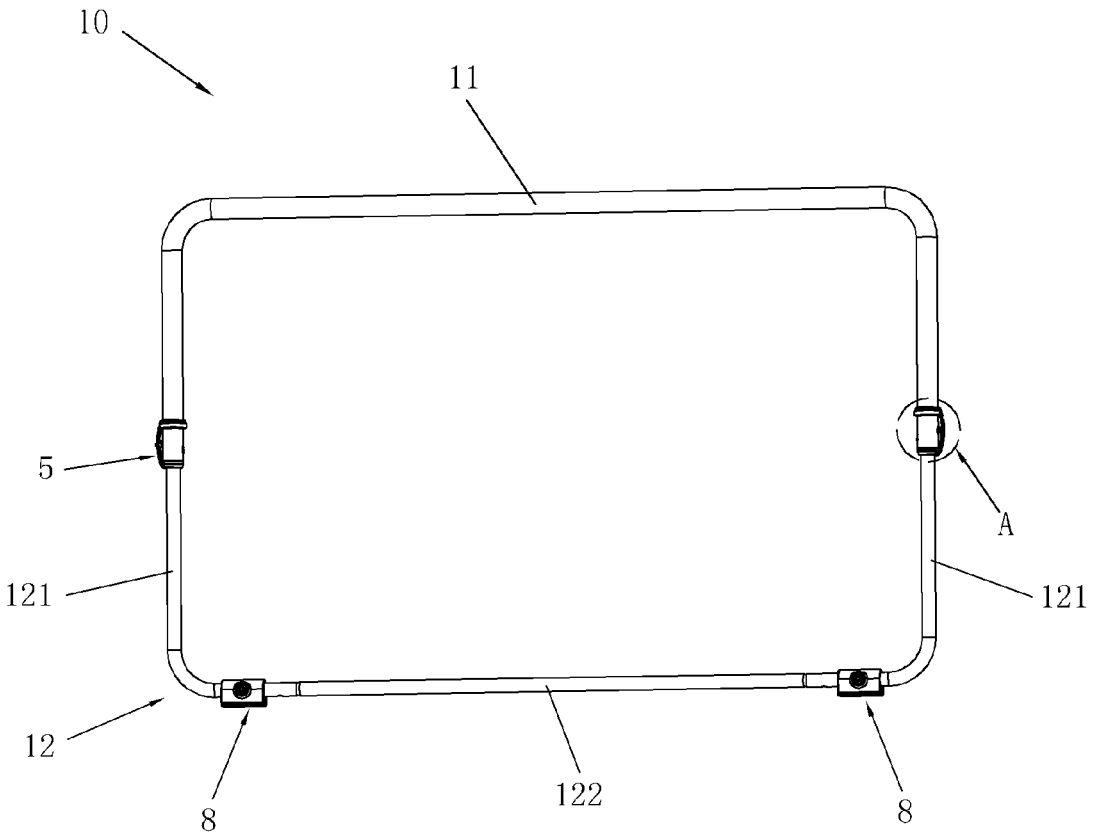
FIG. 14 is a schematic diagram illustrating the inner tube being pulled from the outer tube outwardly.
Figure 17:
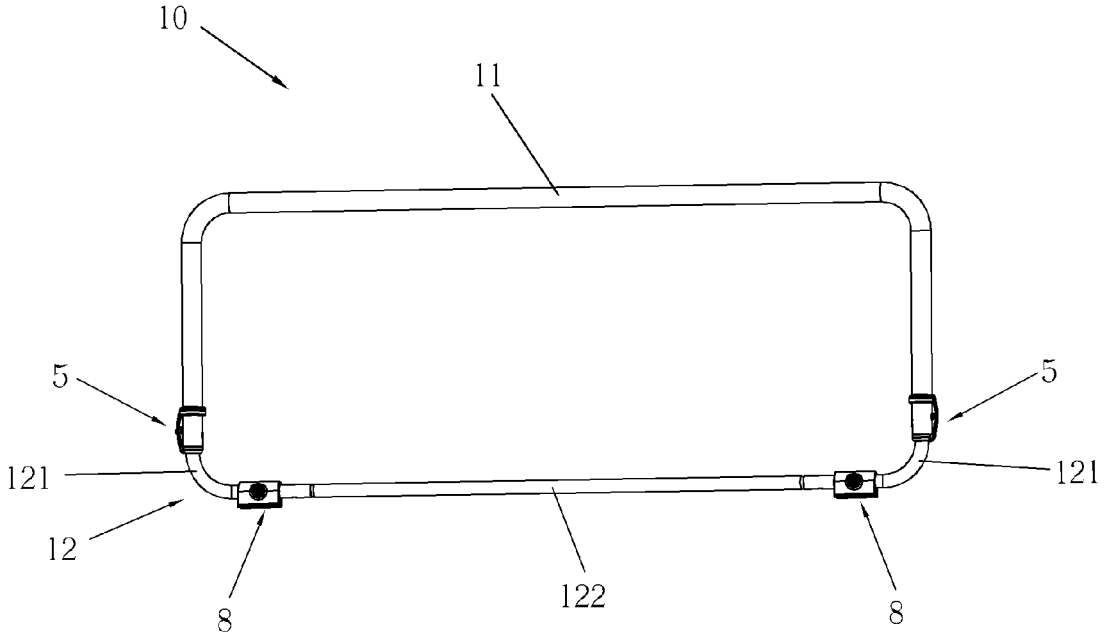
FIG. 17 is a schematic diagram illustrating the inner tube sliding into the outer tube.

As shown in FIGS. 13, 14 and 17, in a third embodiment of the reversible changing table 1 of the invention, the reversible changing table 1 comprises a bracket 10, a first pivoting assembly 200 and a second pivoting assembly 300, wherein the bracket 10 can be installed on the crib frame 2 (as shown in FIG. 1) through the first pivoting assembly 200 and the second pivoting assembly 300. It should be noted that the structures and principles of the first pivoting assembly 200 and the second pivoting assembly 300 are substantially similar to the abovementioned first pivoting assembly 20 and second pivoting assembly 30, and will not be depicted herein again. Besides, the connection and arrangement of a first fixing socket 210, a first engaging socket 220, a first pivoting member 250, a button 230, a second fixing socket 310, a second engaging socket 320 and a second pivoting member 330 are also similar as those in the second embodiment. Still further, the abovementioned resilient member 24 can be also disposed between a bottom of the button 230 and the first engaging socket 220 and performs the same function as mentioned in the above.

The bracket 10 comprises an outer tube 11 and an inner tube 12, wherein the outer tube 11 is slidably connected to the inner tube 12 so as to form the bracket 10. When packaging the bracket 10, the inner tube 12 can slide into the outer tube 11 so as to reduce the volume of the bracket 10. On the other hand, when using the bracket 10 normally, the inner tube 12 can be pulled from the outer tube 11 outwardly.

Specifically, a first connecting end of the inner tube 12 is inserted into a second connecting end of the outer tube 11. In this embodiment, the outer tube 11 is U-shaped and the inner tube 12 is reversed U-shaped such that the outer tube 11 and the inner tube 12 can be connected to each other so as to form the bracket 10. An external diameter of the inner tube 12 is smaller than an internal diameter of the outer tube 11 such that an open side of the inner tube 12 (i.e. both ends of the inner tube 12 due to the reversed U-shape) can be inserted into an open side of the outer tube 11 (i.e. both ends of the outer tube 11 due to the U-shape) and the outer tube 11 and the inner tube 12 can slide with respect to each other.

Figure 15:
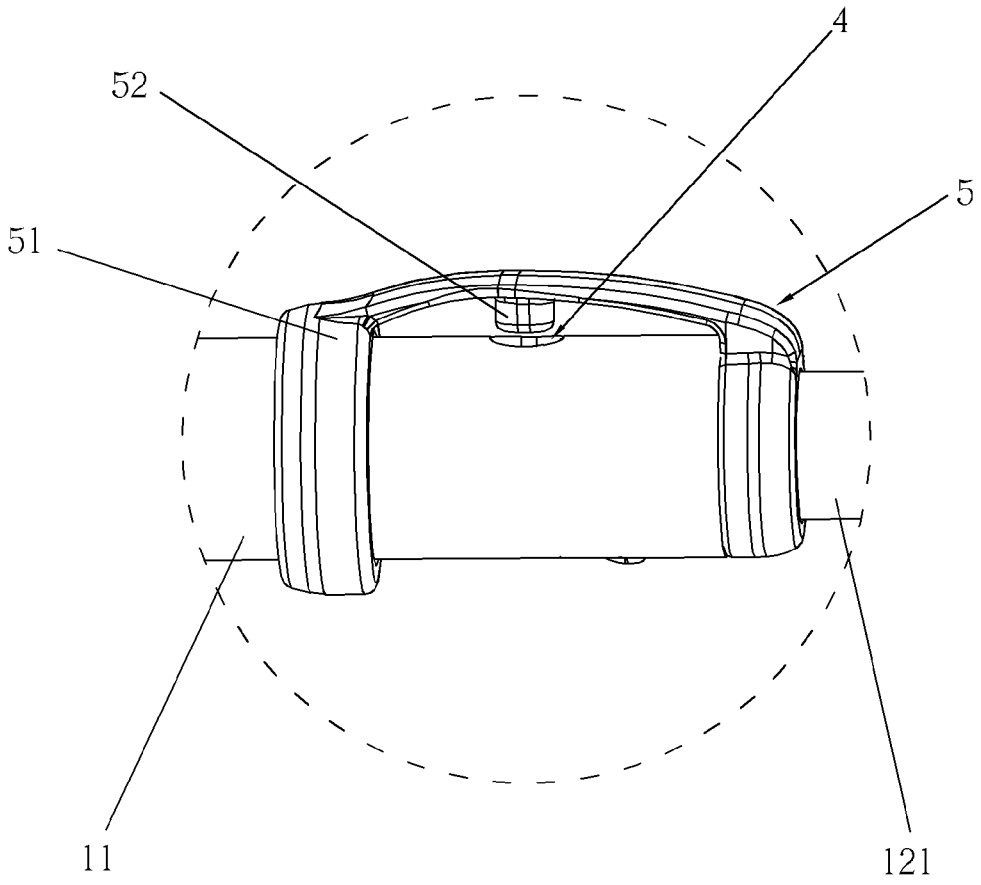
FIG. 15 is an enlarged view illustrating the area A shown in FIG. 14
Figure 16:
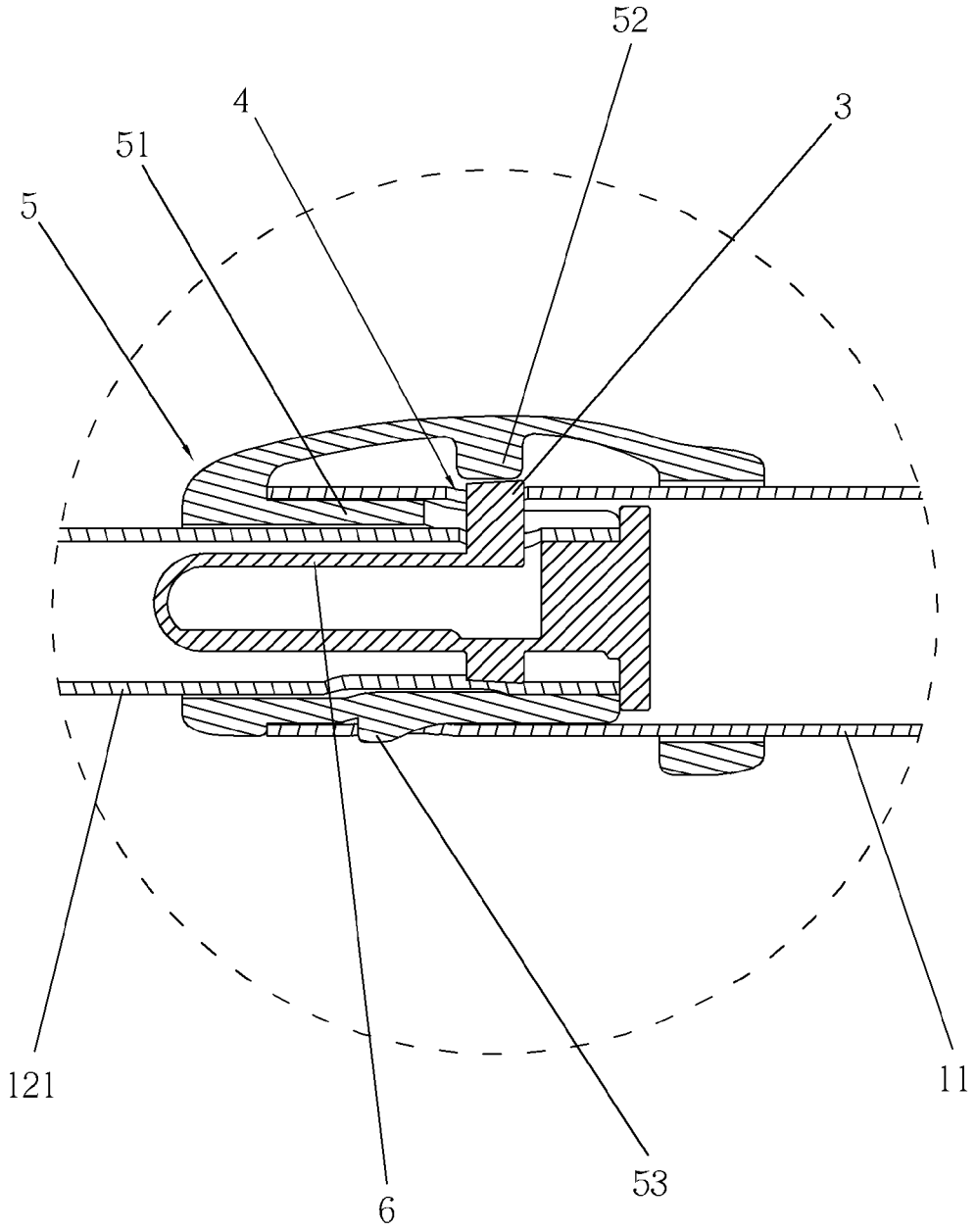
FIG. 16 is a cross-sectional view illustrating the structure shown in FIG. 15.

Preferably, as shown in FIGS. 15 and 16, the first connecting end of the inner tube 12 has an engaging portion 3, an engaging hole 4 is formed on the second connecting end of the outer tube 11, and the inner tube 12 can be locked with the outer tube 11 by engaging the engaging portion 3 and the engaging hole 4. When the engaging portion 3 is engaged into the engaging hole 4, the outer tube 11 and the inner tube 12 are locked and cannot slide with respect to each other, i.e. the outer tube 11 and the inner tube 12 are connected to each other fixedly. When the engaging portion 3 is disengaged from the engaging hole 4, the outer tube 11 and the inner tube 12 are unlocked and can slide with respect to each other. At this time, the outer tube 11 and the inner tube 12 are slidably connected to each other. That is to say, the inner tube 12 can slide into the outer tube 11 so as to reduce the volume of the bracket 10.

For further description, a connecting member 5 is fixed on the second connecting end of the outer tube 11 and comprises a sleeve portion 51, a press portion 52 and a positioning portion 53, wherein the sleeve portion 51 is fixed on an inner wall of the outer tube 11, the inner tube 12 can be inserted into the sleeve portion 51, the press portion 52 is used for pressing the engaging portion 3 so as to disengage the engaging portion 3 from the engaging hole 4, and the positioning portion 53 is used for fixing the connecting member 5 on the outer tube 11. A spring plate 6 is disposed in the first connecting end of the inner tube 12, the engaging portion 3 is located at one end of the spring plate 6 and protrudes from the inner tube 12, and the engaging portion 3 is engaged into the engaging hole 4 by an elastic force generated by the spring plate 6. When the press portion 52 is pressed to disengage the engaging portion 3 form the engaging hole 4, the inner tube 12 can slide into the outer tube 11 rightward, as shown in FIG. 16. When a user wants to use the reversible changing table 1, he or she can pull the inner tube 12 out from the outer tube 11 leftward and the engaging portion 3 will be engaged into the engaging hole 4 again by the elastic force generated by the spring plate 6. Consequently, the outer tube 11 and the inner tube 12 are locked again. In this embodiment, the press portion 52 is disposed on the connecting member 5 through an arc bridge. When the press portion 52 is situated in a free state, the press portion 52 is located above the engaging hole 4. When the press portion 52 is pressed, the press portion 52 can go into the engaging hole 4. When the press portion 52 is released, the press portion 52 returns to the free state due to an elastic force generated by the arc bridge. The positioning portion 53 may be, but not limited to, a resilient buckle passing through the outer tube 11 and engaged with the outer tube 11.

Figure 18:
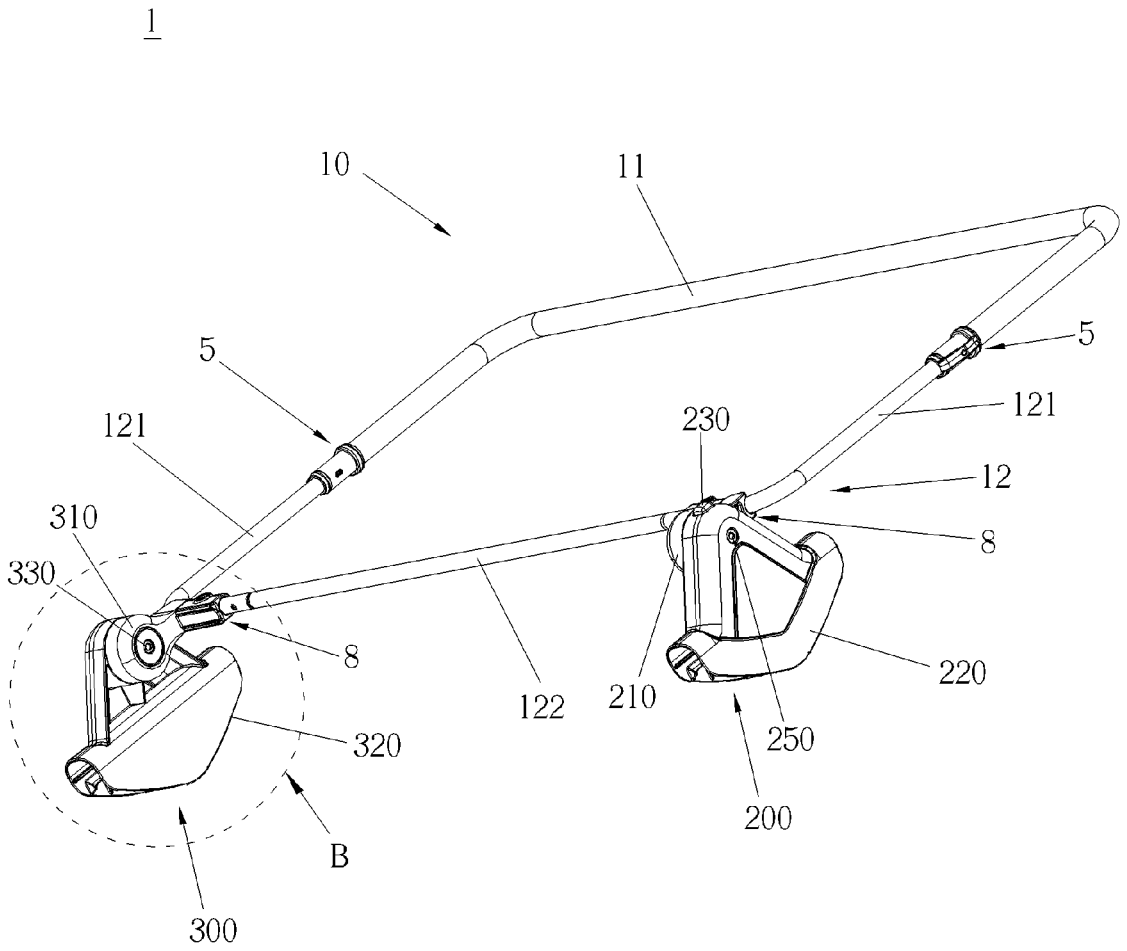
FIG. 18 is a schematic diagram illustrating the reversible changing table shown in FIG. 13 from another view angle.
Figure 19:
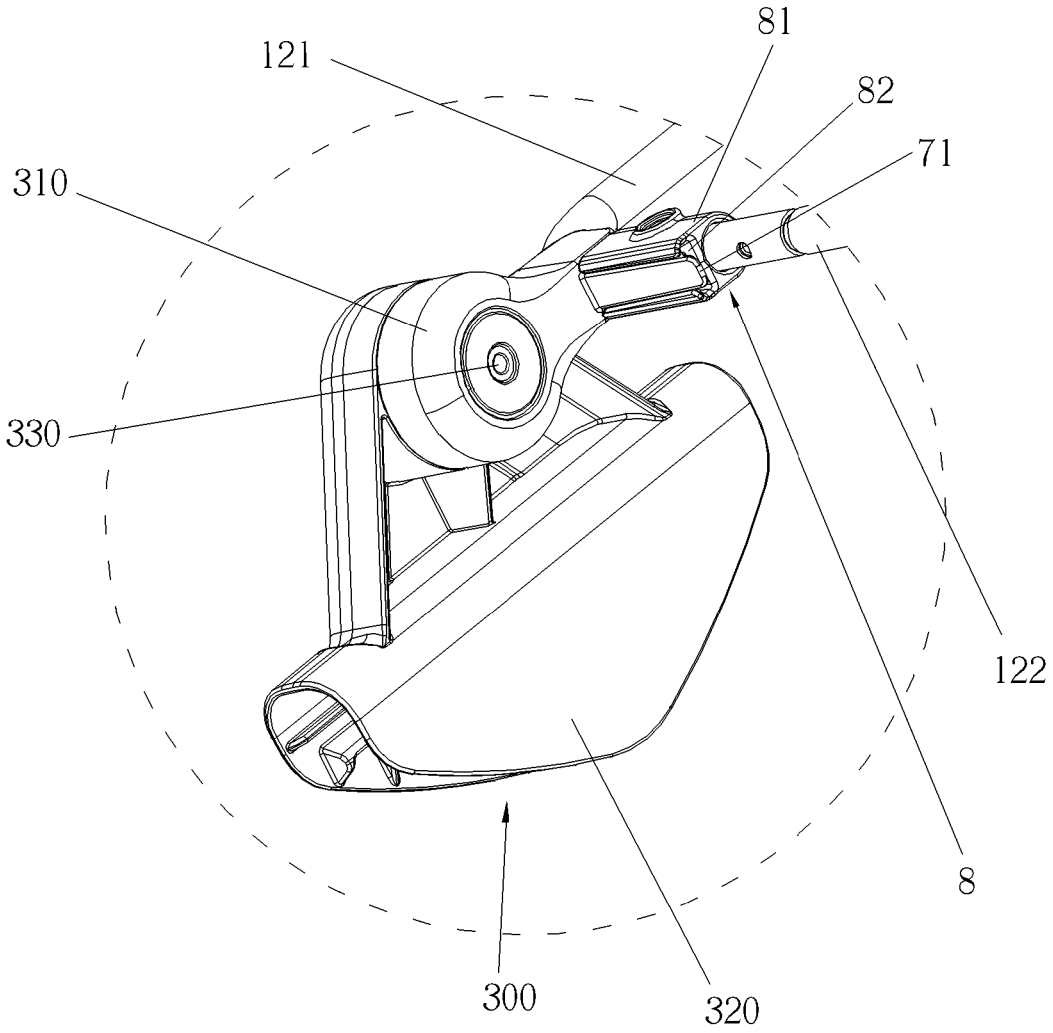
FIG. 19 is an enlarged view illustrating the area B shown in FIG. 18.
Figure 20:
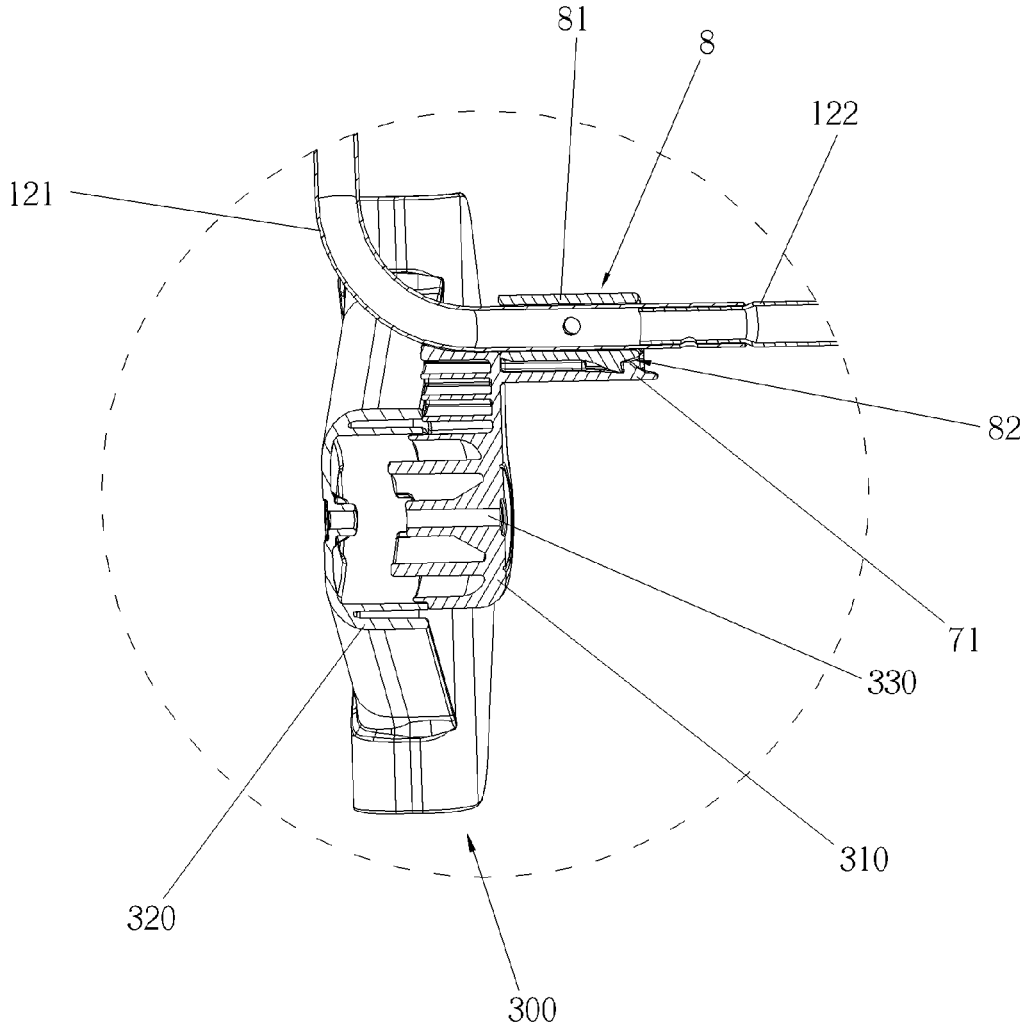
FIG. 20 is a cross-sectional view illustrating the structure shown in FIG. 19.

Preferably, as shown in FIGS. 18 to 20, the inner tube 12 comprises two transition tubes 121 and a connecting tube 122, the connecting tube 122 is connected between the two transition tubes 121, and each of the transition tubes 121 is slidably connected to the outer tube 11. In this embodiment, both ends of the connecting tube 122 are inserted into the two transition tubes 121, respectively, and are fixed by spring plates (not shown) so as to assemble or disassemble the inner tube 12. However, the invention is not limited to the aforesaid embodiments and the connecting tube 122 may be fixed to the transition tubes 121 by screws or rivets.

Preferably, the reversible changing table 1 of the invention may further comprise an engaging member 8 fixed on the inner tube 12. A first connecting portion 71 protrudes from the second pivoting assembly 300 (as shown in FIGS. 19 and 20) and the engaging member 8 has a second connecting portion 82. The inner tube 12 can be connected to the second pivoting assembly 300 by connecting the first connecting portion 71 and the second connecting portion 82. It should be noted that the first pivoting assembly 200 may also have the first connecting portion 71 for connecting the engaging member 8 and the inner tube 12. One of the first connecting portion 71 and the second connecting portion 82 may be an engaging hook and the other one of the first connecting portion 71 and the second connecting portion 82 may be an engaging groove. In this embodiment, the first connecting portion 71 is an engaging hook and the second connecting portion 82 is an engaging groove.

Specifically, the engaging member 8 has a sleeve portion 81 and the inner tube 12 can be inserted and fixed into the sleeve portion 81. The second connecting portion 82, which can be engaged with or disengaged from the first connecting portion 71, is formed outside the sleeve portion 81. The first connecting portion 71 can be operated to be engaged with or disengaged from the second connecting portion 82 so as to engage the engaging member 8 with the first and second pivoting assemblies 200, 300 or disengage the engaging member 8 from the first and second pivoting assemblies 200, 300. When the first connecting portion 71 is engaged with the second connecting portion 82 of the engaging member 8, the engaging member 8 is engaged with the first and second pivoting assemblies 200, 300 accordingly. When the first connecting portion 71 is disengaged from the second connecting portion 82 of the engaging member 8, the engaging member 8 is disengaged from the first and second pivoting assemblies 200, 300 accordingly so that the engaging member 8 can be detached from the first and second pivoting assemblies 200, 300. Consequently, the inner tube 12 can be detached from the first and second pivoting assemblies 200, 300 such that the bracket 10 can be detached from the first and second pivoting assemblies 200, 300. In this way, the crib and the reversible changing table thereof can be packaged and transported more conveniently.

In this embodiment, the bracket 10 is rectangular as well as the crib frame 2 such that the outer tube 11 and the inner tube 12 can slide with respect to each other more smoothly. However, the bracket 10 may be formed as other shapes except rectangular in another embodiment.

The structure and arrangement of the reversible changing table 1 of the invention may be also used in other child devices based on practical applications except the crib.

The structure and arrangement of the crib frame 2 of the invention are well known by one skilled in the art and will not be depicted herein.

Compared to the prior art, since the reversible changing table of the invention comprises the pivoting mechanism and the bracket, which is installed on the crib frame through the pivoting mechanism, the bracket is capable of being rotated with respect to the crib frame. Furthermore, the locking mechanism of the pivoting mechanism can be used for preventing the bracket from being rotated with respect to the crib frame. Therefore, a first surface and a second surface with different functions can be arranged on opposite sides of the bracket and the bracket can be rotated with respect to the crib frame so as to use the first surface or the second surface selectively. Accordingly, the reversible changing table of the invention occupies less space of the crib such that the space of the crib can be used efficiently. Still further, the reversible changing table of the invention has simple structure and can be used conveniently.

Moreover, if the bracket comprises an outer tube and an inner tube and the outer tube is slidably connected to the inner tube so as to form the bracket, the inner tube can slide into the outer tube when packaging the bracket so as to reduce the volume of the bracket and reduce package materials of the bracket. Accordingly, the changing table can be packaged and transported more easily and conveniently.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reversible changing table installed on a crib frame of a crib comprising:

a bracket; and a pivoting mechanism disposed on at least one corner of the bracket and having a locking mechanism;

wherein the bracket is installed on the crib frame through the pivoting mechanism such that the bracket is capable of being rotated with respect to the crib frame, and the locking mechanism is used for preventing the bracket from being rotated with respect to the crib frame;

wherein the pivoting mechanism comprises a first pivoting assembly, the first pivoting assembly comprises a first fixing socket and a first engaging socket, the locking mechanism comprises a button, the first fixing socket is pivotally connected to the first engaging socket and fixed on the bracket, the first engaging socket is fixed on the crib frame, the button is slidably disposed on the first engaging socket and is detachably engaged with the first fixing socket, the first fixing socket is capable of pivoting with respect to the first engaging socket so as to rotate the bracket with respect to the crib frame.

2. The reversible changing table of claim 1, wherein one end of the first fixing socket has a first fixing portion, a bottom of the first fixing portion is caved in to form a curved structure, another end of the first fixing socket has a first pivoting portion with circular shape, the curved structure of the first fixing portion is engaged with the bracket, the first pivoting portion is pivotally connected to the first engaging socket.

3. The reversible changing table of claim 2, wherein the first engaging socket has a second fixing portion, a second pivoting portion protrudes from the second fixing portion and is corresponding to the first pivoting portion, the second pivoting portion is pivotally connected to the first pivoting portion by a first pivoting member, the second fixing portion is engaged with the crib frame.

4. The reversible changing table of claim 3, wherein an installation groove is formed on the second pivoting portion, the button is slidably accommodated in the installation groove and protrudes from the installation groove, the button is slidably engaged with the first pivoting portion.

5. The reversible changing table of claim 4, wherein the locking mechanism further comprises a resilient member, an upper end of the button has a first protruding block, a lower end of the button has a second protruding block, a middle portion of the button has an engaging block, a recess is formed between the first protruding block and the engaging block, a slot is formed between the engaging block and the second protruding block, the first pivoting member is inserted into the slot and connected to the first engaging socket, the resilient member is disposed between a bottom of the button and the second pivoting portion.

6. The reversible changing table of claim 5, wherein the first pivoting portion has two protruding ribs arranged symmetrically, a gap is formed between the two protruding ribs, the button is disposed in the gap and slidably engaged with the two protruding ribs.

7. The reversible changing table of claim 6, wherein the engaging block and the second protruding block are engaged between the two protruding ribs when the button is locked and the two protruding ribs are aligned with the recess after the button is unlocked.

8. The reversible changing table of claim 3, wherein a step-shaped structure is formed on an edge of the first pivoting portion, and an engaging groove, which is corresponding to the step-shaped structure of the first pivoting portion, is formed on an edge of the second pivoting portion.

9. The reversible changing table of claim 1, wherein the pivoting mechanism further comprises a second pivoting assembly, the second pivoting assembly and the first pivoting assembly both are disposed on one side of the bracket and fixed between the bracket and the crib frame.

10. The reversible changing table of claim 9, wherein the second pivoting assembly comprises a second fixing socket, a second engaging socket and a second pivoting member, the second fixing socket is fixed on the bracket, the second engaging socket is fixed on the crib frame, and the second fixing socket is pivotally connected to the second engaging socket by the second pivoting member.

11. The reversible changing table of claim 1, wherein the bracket comprises an outer tube and an inner tube, the outer tube is slidably connected to the inner tube so as to form the bracket.

12. The reversible changing table of claim 11, wherein a first connecting end of the inner tube is inserted into a second connecting end of the outer tube.

13. The reversible changing table of claim 12, wherein the first connecting end of the inner tube has an engaging portion, an engaging hole is formed on the second connecting end of the outer tube, and the inner tube is locked with the outer tube by engaging the engaging portion and the engaging hole.

14. The reversible changing table of claim 13, wherein a connecting member is fixed on the second connecting end of the outer tube, the connecting member comprises a sleeve portion and a press portion, the sleeve portion is fixed on an inner wall of the outer tube, the inner tube is inserted into the sleeve portion, the press portion is used for pressing the engaging portion so as to disengage the engaging portion from the engaging hole.

15. The reversible changing table of claim 14, wherein the connecting member comprises a spring plate, the spring plate is disposed in the first connecting end of the inner tube, the engaging portion is located at one end of the spring plate, the engaging portion is engaged into the engaging hole by an elastic force generated by the spring plate once the engaging portion is aligned with the engaging hole.

16. The reversible changing table of claim 11, wherein the inner tube comprises two transition tubes and a connecting tube, the connecting tube is connected between the two transition tubes, and each of the transition tubes is slidably connected to the outer tube.

17. The reversible changing table of claim 11, further comprising an engaging member fixed on the inner tube, a first connecting portion protruding from the pivoting mechanism, the engaging member having a second connecting portion, the inner tube being connected to the pivoting mechanism by connecting the first connecting portion and the second connecting portion.

18. The reversible changing table of claim 17, wherein the engaging member has a sleeve portion, the inner tube is inserted into the sleeve portion, and the second connecting portion is formed outside the sleeve portion.

19. The reversible changing table of claim 17, wherein one of the first connecting portion and the second connecting portion is an engaging hook and the other one of the first connecting portion and the second connecting portion is an engaging groove.

20. The reversible changing table of claim 17, wherein the bracket is rectangular.

21. A crib comprising:

a crib frame; and a reversible changing table installed on the crib frame, the reversible changing table comprising:

a bracket; and a pivoting mechanism disposed on at least one corner of the bracket and having a locking mechanism;

wherein the bracket is installed on the crib frame through the pivoting mechanism such that the bracket is capable of being rotated with respect to the crib frame, and the locking mechanism is used for preventing the bracket from being rotated with respect to the crib frame;

wherein the pivoting mechanism is fixed on a middle portion of a longitudinal edge of the crib frame such that the bracket is capable of being rotated in a direction of the longitudinal edge of the crib frame.

22. The crib of claim 21, wherein the bracket is rectangular and a length of the bracket is corresponding to a width of the crib frame.

23. The crib of claim 21, wherein the pivoting mechanism comprises a first pivoting assembly, the first pivoting assembly comprises a first fixing socket and a first engaging socket, the locking mechanism comprises a button, the first fixing socket is pivotally connected to the first engaging socket and fixed on the bracket, the first engaging socket is fixed on the crib frame, the button is slidably disposed on the first engaging socket and is detachably engaged with the first fixing socket, the first fixing socket is capable of pivoting with respect to the first engaging socket so as to rotate the bracket with respect to the crib frame.

24. The crib of claim 23, wherein one end of the first fixing socket has a first fixing portion, a bottom of the first fixing portion is caved in to form a curved structure, another end of the first fixing socket has a first pivoting portion with circular shape, the curved structure of the first fixing portion is engaged with the bracket, the first pivoting portion is pivotally connected to the first engaging socket.

25. The crib of claim 24, wherein the first engaging socket has a second fixing portion, a second pivoting portion protrudes from the second fixing portion and is corresponding to the first pivoting portion, the second pivoting portion is pivotally connected to the first pivoting portion by a first pivoting member, the second fixing portion is engaged with the crib frame.

26. The crib of claim 25, wherein an installation groove is formed on the second pivoting portion, the button is slidably accommodated in the installation groove and protrudes from the installation groove, the button is slidably engaged with the first pivoting portion.

27. The crib of claim 26, wherein the locking mechanism further comprises a resilient member, an upper end of the button has a first protruding block, a lower end of the button has a second protruding block, a middle portion of the button has an engaging block, a recess is formed between the first protruding block and the engaging block, a slot is formed between the engaging block and the second protruding block, the first pivoting member is inserted into the slot and connected to the first engaging socket, the resilient member is disposed between a bottom of the button and the second pivoting portion.

28. The crib of claim 27, wherein the first pivoting portion has two protruding ribs arranged symmetrically, a gap is formed between the two protruding ribs, the button is disposed in the gap and slidably engaged with the two protruding ribs.

29. The crib of claim 28, wherein the engaging block and the second protruding block are engaged between the two protruding ribs when the button is locked and the two protruding ribs are aligned with the recess after the button is unlocked.

30. The crib of claim 25, wherein a step-shaped structure is formed on an edge of the first pivoting portion, and an engaging groove, which is corresponding to the step-shaped structure of the first pivoting portion, is formed on an edge of the second pivoting portion.

31. The crib of claim 23, wherein the pivoting mechanism further comprises a second pivoting assembly, the second pivoting assembly and the first pivoting assembly both are disposed on one side of the bracket and fixed between the bracket and the crib frame.

32. The crib of claim 31, wherein the second pivoting assembly comprises a second fixing socket, a second engaging socket and a second pivoting member, the second fixing socket is fixed on the bracket, the second engaging socket is fixed on the crib frame, and the second fixing socket is pivotally connected to the second engaging socket by the second pivoting member.

33. The crib of claim 21, wherein the bracket comprises an outer tube and an inner tube, the outer tube is slidably connected to the inner tube so as to form the bracket.

34. The crib of claim 33, wherein a first connecting end of the inner tube is inserted into a second connecting end of the outer tube.

35. The crib of claim 34, wherein the first connecting end of the inner tube has an engaging portion, an engaging hole is formed on the second connecting end of the outer tube, and the inner tube is locked with the outer tube by engaging the engaging portion and the engaging hole.

36. The crib of claim 35, wherein a connecting member is fixed on the second connecting end of the outer tube, the connecting member comprises a sleeve portion and a press portion, the sleeve portion is fixed on an inner wall of the outer tube, the inner tube is inserted into the sleeve portion, the press portion is used for pressing the engaging portion so as to disengage the engaging portion from the engaging hole.

37. The crib of claim 36, wherein the connecting member comprises a spring plate, the spring plate is disposed in the first connecting end of the inner tube, the engaging portion is located at one end of the spring plate, the engaging portion is engaged into the engaging hole by an elastic force generated by the spring plate once the engaging portion is aligned with the engaging hole.

38. The crib of claim 33, wherein the inner tube comprises two transition tubes and a connecting tube, the connecting tube is connected between the two transition tubes, and each of the transition tubes is slidably connected to the outer tube.

39. The crib of claim 33, wherein the reversible changing table further comprises an engaging member fixed on the inner tube, a first connecting portion protrudes from the pivoting mechanism, the engaging member has a second connecting portion, and the inner tube is connected to the pivoting mechanism by connecting the first connecting portion and the second connecting portion.

40. The crib of claim 39, wherein the engaging member has a sleeve portion, the inner tube is inserted into the sleeve portion, and the second connecting portion is formed outside the sleeve portion.

41. The crib of claim 39, wherein one of the first connecting portion and the second connecting portion is an engaging hook and the other one of the first connecting portion and the second connecting portion is an engaging groove.

* * * * *